US005409406A

United States Patent [19]

McClure

[11] Patent Number: 5,409,406

[45] Date of Patent: Apr. 25, 1995

[54] CONNECTOR FOR HIGH DENSITY ELECTRONIC ASSEMBLIES

[75] Inventor: Robert G. McClure, Lancaster, Pa.

[73] Assignee: Berg Technology, Inc., Reno, Nev.

[21] Appl. No.: 169,586

[22] Filed: Dec. 17, 1993

[51] Int. Cl.[6] ..... H01R 13/115

[52] U.S. Cl. ..... 439/857

[58] Field of Search ..... 439/62, 65, 83, 636, 439/660, 682, 856, 857

[56] References Cited

U.S. PATENT DOCUMENTS

| | | | |
|---|---|---|---|
| 3,503,036 | 3/1970 | Desso et al. | 439/857 |
| 3,864,004 | 2/1975 | Friend | 439/844 |
| 4,183,611 | 1/1980 | Casciotti et al. | 439/876 |
| 4,781,611 | 11/1988 | Leonard | 439/856 |
| 5,013,264 | 5/1991 | Tondreault | 439/636 |
| 5,104,324 | 4/1992 | Grabbe et al. | 439/62 |
| 5,199,884 | 4/1993 | Kaufman et al. | 439/74 |

*Primary Examiner*—Gary F. Paumen
*Attorney, Agent, or Firm*—Woodcock, Washburn, Kurtz, Mackiewicz & Norris

[57] ABSTRACT

An electrical connector includes a housing and a plurality of terminals secured within the housing for mounting a mating connector or an electronic module or the like having a plurality of electronic leads disposed thereon to a printed substrate. A first contact beam is cantilevered from a base portion and has a distal end, while a second contact beam is similarly cantilevered from a base portion and also has a distal end wherein a gap is formed between the distal ends of the contact beams. The leads of the mating connectors or the like are inserted into the gap for contacting engagement with the contact beams. A gap adjustment integrally connected to the base portion provides for simple adjustment of the size of the gap between the contact beams.

7 Claims, 2 Drawing Sheets

CONNECTOR FOR HIGH DENSITY ELECTRONIC ASSEMBLIES

FIELD OF THE INVENTION

This invention relates to a connector having a plurality of terminals for connecting a mating connector or the like to a circuit board. More particularly, this invention relates to a connector having a plurality of terminals wherein each terminal comprises two resilient contact beams having free distal ends which are separated by a gap for receiving a lead of a mating connector or the like and wherein a gap adjustment provides for simple adjustment of the size of the gap.

BACKGROUND OF THE INVENTION

Miniature and portable electronic devices are among the fastest growing segments of the electronics industry. Among these devices are cellular phones operating with a ground cell network, satellite communication net terminals, laser and infrared measurement instruments, and work-stations including combinations of personal computers, facsimile machines with voice telecommunication terminals and notebook computers.

An important trend in the electronics industry has been the increasing utilization of integrated circuits as individual components due to their relatively inexpensive cost, miniature size, and electrical dependability. Today it is common for hundreds of complex integrated circuits to be treated as discrete components by the design engineer, with such integrated circuits being appropriately packaged and electrically connected to their associated printed circuit boards.

Many of the current electronic designs contain a variety of components such as, flexible, rigid, and semi-rigid printed circuit boards, hybrid circuits and large silicon integrated circuits. These components must be mounted together by electrical connectors having a plurality of terminal contacts which provide for inexpensive latching and containment of the electronic components.

Connectors having tuning fork type dual beam contact terminals wherein a gap is provided between the contact terminals are known for providing a mounting connection between an electronics package and a printed circuit board or the like. Leads of the electronics package are inserted into the gap for making contact with one or both of the contact terminals such that the electronics package is electrically interconnected with the printed circuit board. However, in order to manufacture these types of terminal having an extremely small gap size, the punching device which forms the gap from the terminal material during a stamping operation must also be extremely small. However, due to the forces exerted on the punching devices during a stamping operation, small punch devices are prone to breaking under the influence of such forces.

Therefore, there is a need for a low cost, high density connector having a plurality of terminal contacts which can be simply manufactured, allows for simple and effective regulation of insertion forces, has the strength necessary for providing a reliable connection between an electronic module or the like and a printed circuit board and which can be simply adjusted to provide a varying gap size between terminal contacts. The present invention provides an electrical connector which satisfies this need.

SUMMARY OF THE INVENTION

Accordingly, it is an object of the invention to provide an improved connector for a high-density electronic module, mating connector or the like that is inexpensive and simple in construction.

An electrical connector in accordance with the present invention comprises a housing and a plurality of terminals secured in the housing for connecting a mating connector or the like to a printed substrate. Each of the terminals has a first and second base portion. The first base portion has a first contact beam cantilevered therefrom, with the first contact beam having a first distal end. Similarly, the second base portion has a second contact beam cantilevered therefrom, with the second contact beam having a second distal end, and wherein a gap is formed between the first and second distal ends. The first and second contact beams are for receiving an electrical lead inserted in the gap such that the electrical lead contacts at least one of the distal ends for establishing electrical connection between the lead and the printed substrate and for providing reliable mounting of the mating connector on the printed substrate. A gap adjustment is integrally connected between the first and second base portions for adjusting the size of the gap.

These and various other advantages and features of novelty which characterize the invention are pointed out with particularity in the claims annexed hereto and forming a part hereof. However, for a better understanding of the invention, its advantages, and the objects obtained by its use, reference should be made to the drawings which form a further part hereof, and to the accompanying descriptive matter, in which there is illustrated and described a preferred embodiment of the invention.

DETAILED DESCRIPTION OF THE PREFERRED EMBODIMENT(S)

Figure 1:
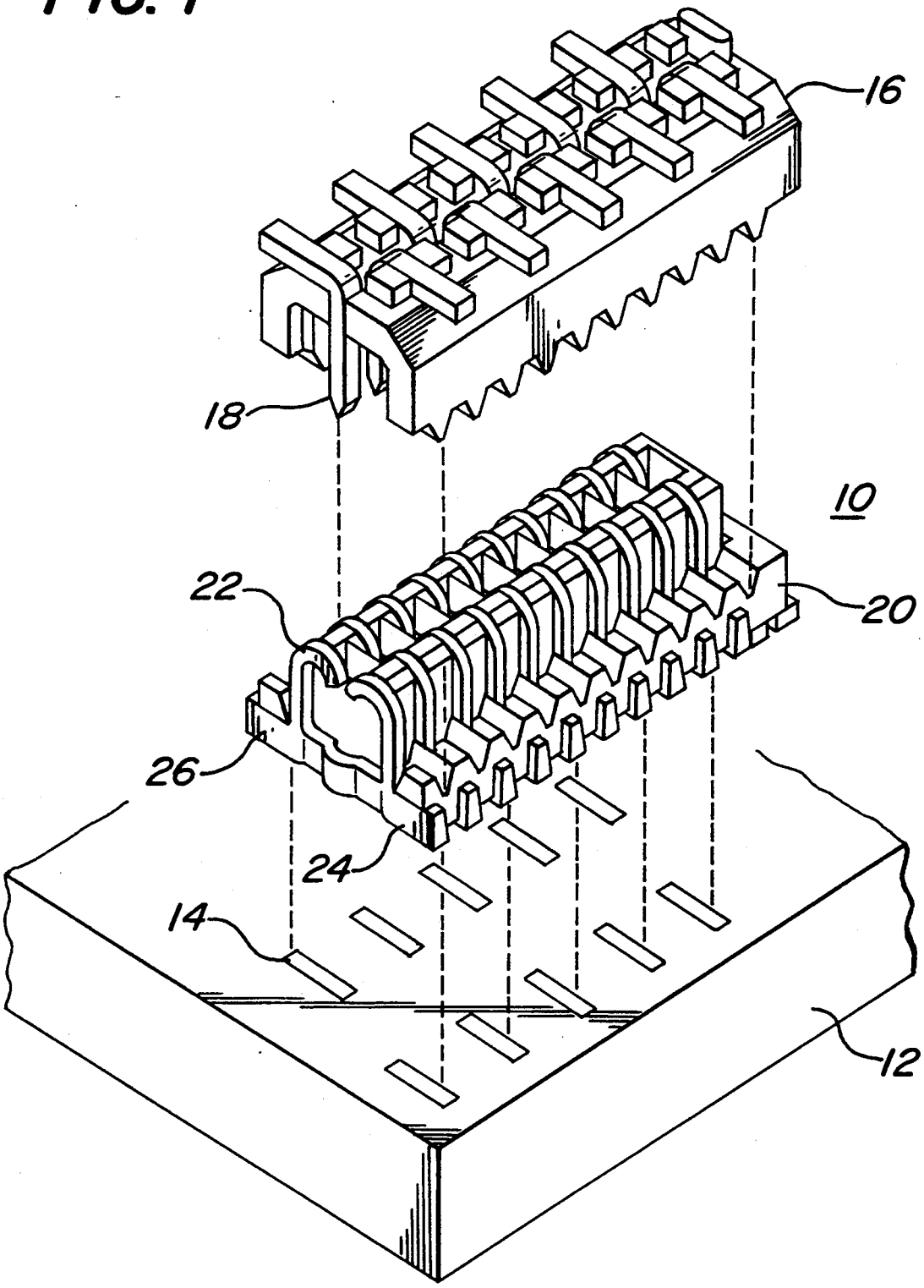
FIG. 1 is an exploded perspective view of a connector in accordance with the present invention.

Referring now to the drawings, wherein like reference numerals designate corresponding structure throughout the views, and referring in particular to FIG. 1, an improved connector 10 is constructed and arranged to be attached to a motherboard or substrate 12 that has contacts 14, preferably comprising copper, thereon. Contacts 14 can be pads of solder disposed on substrate 12 in a known manner or plated through holes. Substrate 12 can be a printed circuit board or the like having electronic circuitry printed thereon for carrying out specific functions in a known manner. Connector 10 is adapted to receive an electronic male connector 16 that is of the type that has a plurality of leads 18 positioned on an underside thereof. Leads 18 can be, for example, contact pins that are bent downwardly orthogonally to the plane of the male connector 16 as shown in FIG. 1. However, the present invention is not intended to be limited in this manner and connector 10 can be adapted to receive a variety of electronic modules or the like, as set forth in further detail below, such as a thin card-type electronic module having a plurality of flat contact pad leads positioned on an underside thereof and adjacent to one or more edges of the electronic module.

Connector 10 includes a housing 20 preferably fabricated from a non-conductive, non-metallic material, such as hard plastic. A plurality of connector terminals 22 are positioned in and securely mounted in housing 20. Terminals 22 preferably comprise a material having a high electrical conductivity and high elastic modulus, such as phosphorous bronze or beryllium bronze, and can be formed by any known manufacturing method, such as stamping or etching.

Figure 2:
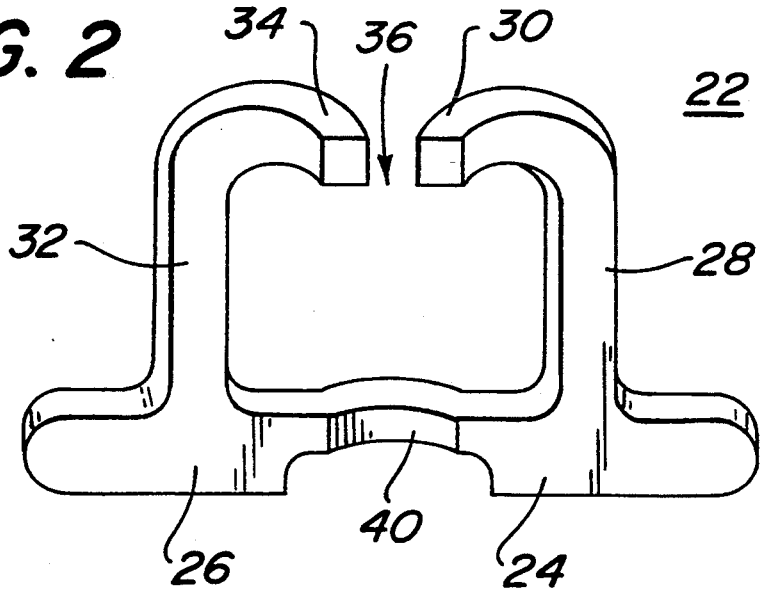
FIG. 2 is a perspective view of a connector terminal in accordance with the present invention.

As shown in FIG. 2, a terminal 22 includes base portions 24, 26. A resilient first contact beam 28 is cantilevered from base portion 24 and has a distal end 30. Similarly, a resilient second contact beam 32 is cantilevered from base portion 26 and has a distal end 34. The longitudinal plane of terminal 22 is herein defined as that plane in which contact beams 28, 32 are cantilevered from their respective base portions 24, 26. A gap 36 is formed between the distal ends 30, 34 of the contact beams 28, 32 and the contact beams receive lead 18 inserted in the gap 36, as shown in FIG. 1, such that the electrical lead 18 contacts at least one of the distal ends 30, 34 for establishing electrical connection between the lead and the printed substrate 12. As shown in the embodiment of FIG. 2, distal ends 30, 34 can be bent at an angle to the longitudinal plane of the terminal. In a preferred embodiment, distal ends 30, 34 are bent orthogonally to the longitudinal plane of the terminal. In this embodiment, the leads of a mating connector or the like are inserted substantially perpendicular to the longitudinal plane of the terminal.

The terminal embodiment shown in FIG. 2 can be surface mounted to the contact pads of a printed circuit board or the like wherein base portions 24, 26 are solderably connected to the contact pads in a known manner. However, the present invention is not intended to be limited in this manner and various other types of terminal mounting techniques are within the scope of the invention. For example, the terminal embodiment shown in FIG. 3 includes an attachment tail 39 which can be mounted in a plated through hole in the printed substrate in a known manner for connecting the terminal to a contact pad on the circuit board.

As discussed above, where a particular application requires that connector 10 is connected to an edge card type connector having a plurality of leads on one of the sides thereof, the edge of the card is disposed in the gaps of the adjacent terminals such that the leads contact the distal end of one of the contact beams of the connector terminal.

Gap adjustment 40 is disposed between and integrally joins base portions 24, 26. Gap adjustment 40 can be adjusted to provide a desired size for the gap 36 between the distal ends of the contact beams. In the embodiment shown in FIG. 2, gap adjustment 40 has a curved profile which projects a predetermined depth outside of the longitudinal plane of the terminal. This profile and depth correspond to a particular gap size.

Figure 3:
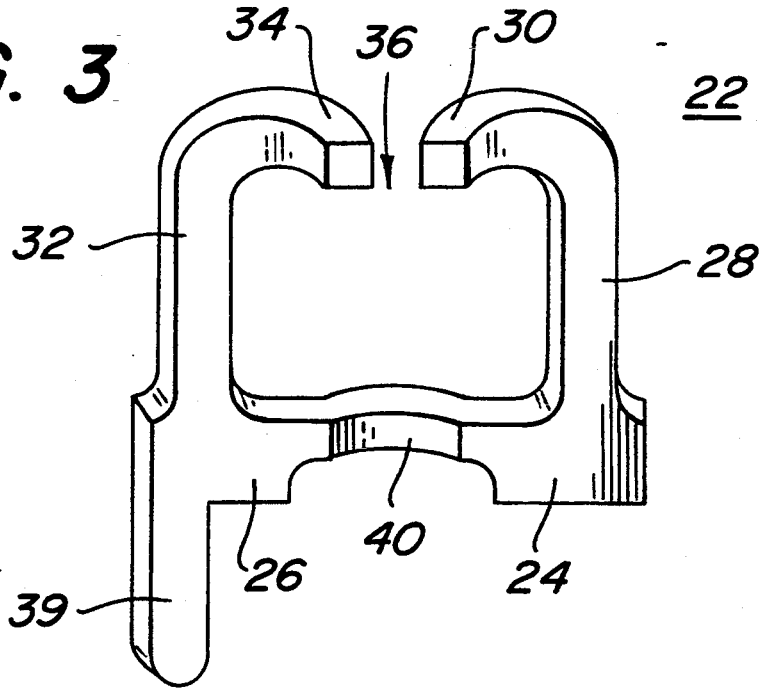
FIG. 3 is a perspective view of a second embodiment of a connector terminal in accordance with the present invention.

Thus, a terminal 22 is manufactured by forming a quantity of terminal material, preferably by stamping, into a desired terminal profile, such as that shown in FIGS. 2 and 3.

In order to adjust the gap size, the depth or the profile, or both, of the gap adjustment 40 is altered to obtain the desired gap size. The gap adjustment can be altered by displacing the gap adjustment material to change the depth at which the gap adjustment extends outside of the longitudinal plane of the terminal and/or by displacing the gap adjustment material to change the profile of the gap adjustment while maintaining a specified depth. It is preferable to form the shape of the gap adjustment for a desired gap size such that the base portions 24, 26 remain aligned in parallel in the longitudinal plane of the terminal.

Thus, a connector in accordance with the present invention provides low cost, low-profile connector terminals which can be densely packed together and which provide a reliable latching mechanism for securing a mating connector or the like into electrical connection with a printed substrate. The connector terminals can be simply modified to receive variable size leads of a mating connector or the like.

Although particular embodiments of the present invention have been described and illustrated herein, it is recognized that modifications and variations may readily occur to those skilled in the art. Consequently, it is intended that the claims be intended to cover such modifications and equivalents.

What is claimed is:

1. An electrical connector, comprising:

a housing;

a plurality of terminals secured in said housing, each of said terminals having:

a first and second base portion lying substantially in a common plane, said first base portion having a first contact beam cantilevered therefrom, said first contact beam having a first distal end, said second base portion having a second contact beam cantilevered therefrom, said second contact beam having a second distal end, wherein a gap is formed between said first and second distal ends, said first and second contact beams for receiving an electrical lead inserted in said gap such that the electrical lead contacts at least one of said distal ends for establishing electrical connection between the lead and the printed substrate; and gap adjustment means for adjusting the size of said gap, said gap adjustment means integrally joining said first and second base portions and being bowed out of said plane.

2. An electrical connector according to claim 1, each said terminal constructed such that said first and second base portions and said first and second contact beams are aligned in said plane, wherein said first and second distal ends are bent at an angle to said plane.

3. An electrical connector according to claim 2, wherein said first and second distal ends are bent orthogonally to said plane.

4. An electrical connector according to claim 2, wherein said gap adjustment means has a curved profile projecting outside of said plane.

5. An electrical connector according to claim 1, wherein said gap adjustment means is altered by displacing the material of the gap adjustment means to provide a desired gap size.

6. An electrical connector according to claim 1, each said terminal further having an attachment tail for mounting said terminal in a plated through hole in a printed substrate.

7. A connector terminal, comprising:

a first and second base portion lying substantially in a common plane, said first base portion having a first contact beam cantilevered therefrom, said first contact beam having a first distal end, said second base portion having a second contact beam cantilevered therefrom, said second contact beam having a second distal end, wherein a gap is formed between said first and second distal ends, said first and second contact beams for receiving an electrical lead inserted in said gap such that the electrical lead contacts at least one of said distal ends for establishing electrical connection between the lead and the printed substrate; and gap adjustment means for adjusting the size of said gap, said gap adjustment means integrally joining said first and second base portions and being bowed out of said plane.

* * * * *